US009478874B2

(12) United States Patent
Stolze

(10) Patent No.: US 9,478,874 B2
(45) Date of Patent: Oct. 25, 2016

(54) SPRING-LOADED CONNECTION TERMINAL AND CONDUCTOR CONNECTION TERMINAL

(71) Applicant: WAGO Verwaltungsgesellschaft mbH, Minden (DE)

(72) Inventor: Henry Stolze, Bad Frankenhausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/767,714

(22) PCT Filed: Feb. 12, 2014

(86) PCT No.: PCT/EP2014/052720
§ 371 (c)(1),
(2) Date: Aug. 13, 2015

(87) PCT Pub. No.: WO2014/124962
PCT Pub. Date: Aug. 21, 2014

(65) Prior Publication Data

US 2015/0372401 A1 Dec. 24, 2015

(30) Foreign Application Priority Data

Feb. 13, 2013 (DE) ..... 10 2013 101 411

(51) Int. Cl.
*H01R 11/22* (2006.01)
*H01R 4/48* (2006.01)
*H01R 12/51* (2011.01)

(52) U.S. Cl.
CPC ..... *H01R 4/48* (2013.01); *H01R 4/4836* (2013.01); *H01R 4/4845* (2013.01); *H01R 12/515* (2013.01)

(58) Field of Classification Search
CPC .... H01R 4/48; H01R 4/4845; H01R 4/4836; H01R 12/515; H01R 12/57; H01R 13/2728; H01R 4/4827; H01R 31/085
USPC ..... 439/816
See application file for complete search history.

(56) References Cited

U.S. PATENT DOCUMENTS 5,651,695 A 7/1997 Lee et al.
5,853,304 A * 12/1998 Landreau ..... H01R 31/085 439/716

(Continued)

FOREIGN PATENT DOCUMENTS

DE 7420412 11/1974
DE 19715971 5/1998

(Continued)

OTHER PUBLICATIONS

International Preliminary Report on Patentability for corresponding International application No. PCT/EP2014/052720 dated Aug. 27, 2015.

(Continued)

*Primary Examiner* — Jean F Duverne
(74) *Attorney, Agent, or Firm* — Renner, Otto, Boisselle & Sklar, LLP

(57) ABSTRACT

A spring-loaded terminal connection (1) comprising at least one clamping spring (2), which is bent in the form of a loop, and comprising a busbar (9) is described. The clamping spring (2) has a resting limb (6), which rests on the busbar (9), a spring bend (5), which adjoins the resting limb (6), and a clamping limb (3), which adjoins the spring bend (5) and points with a free clamping end (4) in the direction of the busbar (9). The resting limb (6) has at least one notch (12).

10 Claims, 10 Drawing Sheets

(56) References Cited

U.S. PATENT DOCUMENTS

| | | | | |
|---|---|---|---|---|
| 6,010,376 | A * | 1/2000 | Kollmann | H01R 4/4827 439/803 |
| 2009/0047846 | A1* | 2/2009 | Zhang | H01R 12/57 439/816 |
| 2011/0039456 | A1* | 2/2011 | Katano | H01R 13/11 439/733.1 |
| 2011/0177725 | A1* | 7/2011 | Koyama | H01R 13/2428 439/759 |
| 2011/0189902 | A1* | 8/2011 | Haans | H01R 12/57 439/816 |
| 2013/0029537 | A1* | 1/2013 | Reibke | H01R 4/4818 439/708 |

FOREIGN PATENT DOCUMENTS

| | | |
|---|---|---|
| DE | 29914482 | 1/2001 |
| DE | 20303537 | 5/2003 |
| DE | 10 2004 045 026 | 2/2006 |
| DE | 10 2008 028 575 | 12/2008 |
| DE | 10 2011 056 410 | 6/2013 |
| EP | 0 520 950 | 12/1992 |
| WO | 2012000639 | 1/2012 |

OTHER PUBLICATIONS

International Search Report for corresponding International application No. PCT/EP2014/052720 mailed May 12, 2014.

* cited by examiner

SPRING-LOADED CONNECTION TERMINAL AND CONDUCTOR CONNECTION TERMINAL

This application is a national phase of International Application No. PCT/EP2014/052720 filed Feb. 12, 2014.

The invention relates to a spring-loaded terminal connection comprising at least one clamping spring bent in the form of a loop and comprising a busbar, wherein the clamping spring has a resting limb, which rests against the busbar, a spring bend, which adjoins the resting limb, and a clamping limb, which adjoins the spring bend and points with a free clamping end in the direction of the busbar.

The invention furthermore relates to a conductor connection terminal comprising an insulating housing.

Such spring-loaded terminal connections are used for the terminal connection of electrical conductors, for example in terminal strips, terminal boxes, printed circuit board plug-type connectors, appliance plug-type connectors or the like.

DE 10 2004 045 026 B3 discloses an electrical connection or connecting terminal comprising a clamping spring in the form of a loop which has a resting limb bent in the form of a U, a spring bend adjoining said resting limb and a clamping limb adjoining the spring bend. The resting limb has, in the free end region, a cutout, through which a busbar piece is passed in order to rest on a holder section stamped free from the cutout and a transverse edge delimiting the cutout. The free clamping end of the clamping limb points in the direction of the busbar and, together with the busbar, forms a terminal connection for an electrical conductor to be connected.

WO 2012/000639 A1 discloses a connection terminal comprising a clamping spring in the form of a loop which has laterally protruding actuating tabs at the free clamping end of the clamping limb. A linearly displaceable actuating pushbutton interacts with the actuating tabs in order to open a terminal connection formed by the clamping limb and the one busbar and/or removal of an electrical conductor.

DE 10 2005 048 972 A1 discloses forming the clamping limb of a clamping spring in the form of a loop so as to taper starting from the spring bend and widen again towards the free clamping end. The resting limb is likewise designed to be narrower over a substantial length adjoining the busbar than in the section adjoining the spring bend.

DE 75 37 982 U1 discloses a spring-loaded terminal connection comprising a clamping spring bent in the form of a loop and a busbar. This busbar is passed through a cutout in the resting limb or the spring bend at the transition to the spring bend. The free clamping end of the clamping spring also has a central cutout, from which a flap of material is bent out so as to form a free clamping edge for clamping in an electrical conductor.

Against this background, the object of the present invention consists in providing an improved spring-loaded clamping contact and an improved conductor connection terminal which enables installation in the insulating housing which relieves load on the insulating housing.

The object is achieved by the spring-loaded terminal connection having the features of claim 1 and the conductor connection terminal having the features of claim 10. Advantageous embodiments are described in the dependent claims.

By virtue of the at least one notch, a short web is provided which is narrower than the adjoining section of the resting limb. Such a web forms a flexible joint or hinge. A force acting on the clamping spring via the clamping limb and the spring bend is intercepted via the flexible joint, i.e. the web, in such a way that the clamping spring is thus optimally deformed without exerting any excess forces on an adjoining insulating housing such that the force is dissipated towards the adjoining resting limb and onto the busbar arranged thereon. Thus, the force connection of the clamping spring on an insulating housing is reduced. Therefore, with the aid of the at least one notch in the resting limb, punched-free portions for relieving force loading on the insulating housing are provided.

By virtue of the provision of at least one notch, i.e. a cutout of limited length at the peripheral region of a resting limb so as to form an inlet, furthermore a free space is provided in the resting limb for receiving sections of an insulating housing surrounding the spring-loaded terminal connection or, under certain circumstances, also sections of an actuating element which is built into the insulating housing if the spring-loaded terminal connection is built properly into the insulating housing so as to form a conductor connection terminal.

A notch within the meaning of the present invention is therefore understood to mean a relatively short cutout at the peripheral region of the resting limb, which cutout leads, in the region of the notch, to a web with a reduced width in comparison with the adjoining sections of the resting limb, wherein the web has a shorter length in comparison with the remaining sections of the resting limb.

It is particularly advantageous if a pair of mutually opposite notches is provided on both sides of a resting limb, and the resting limb has, in the region of the notches, a web having a reduced width in comparison with those sections of the resting limb which are directed towards the spring bend and the busbar. Thus, a web is provided which is inwardly offset relative to the side edges of the resting limb on both sides by means of notches. This has the advantage that sections of the insulating housing can dip into a space which is delimited by those side edges of the resting limb which adjoin the web.

The at least one notch is preferably arranged in a space above the busbar. Thus, opposite the terminal connection for the connection of an electrical conductor a hinge is provided between that section of the resting limb which is connected to the busbar and that section of the resting limb which is connected to the clamping limb via the spring bend, which results in the force exerted on the insulating housing surrounding the spring-loaded terminal connection being relieved.

The at least one notch is preferably located in a space above the free clamping end of the clamping spring in the rest state of the clamping spring by virtue of the clamping limb resting on the busbar. The hinge of the clamping spring which is provided by the notches with the web of reduced width therefore acts in relation to the free clamping end of the clamping spring and an insulating housing surrounding the clamping spring at an optimum position.

It is particularly advantageous if the busbar is mounted on the resting limb so as to be capable of performing a tipping movement. Thus, a resilient run-on bevel of the busbar which matches the conductor is provided, which run-on bevel can advantageously be reduced by the force acting on the insulating housing when an electrical conductor is plugged into or connected to the spring-loaded terminal connection. The arrangement whereby the busbar is mounted on the resting limb such that it is capable of performing a tipping movement is in principle independent of the above-described special embodiment of the spring-loaded terminal connection comprising a notch and can also achieve its advantageous effect in the case of clamping springs without such a notch. In the case of a clamping spring which is bent in the form of a loop and comprises a busbar, wherein the clamping spring has a resting limb resting on the busbar, a spring bend adjoining the resting limb and a clamping limb, which adjoins the spring bend and points with a free clamping end in the direction of the busbar, it is therefore advantageous that the busbar is mounted on the resting limb in such a way as to be capable of performing a tipping movement.

It is particularly advantageous if the resting limb has, at its free end section, bearing openings or bearing depressions. The busbar then has protruding bearing lugs, which each dip into an assigned bearing opening or bearing depression such that the busbar is mounted on the resting limb in such a way as to be capable of performing a tipping movement.

The busbar is therefore not fitted to the resting limb immovably by welding or riveting, but is suspended in the resting limb and mounted on the resting limb in such a way as to be capable of performing a tipping movement. Owing to the fact that the busbar is latched on the resting limb by means of bearing lugs, the busbar is fixed in position relative to the at least one clamping spring.

The bearing openings or bearing depressions can be surrounded on all sides by free end sections of the resting limb. However, it is also conceivable that bearing openings at the free end section of the resting limb are in the form of notches in the peripheral regions of the free end section. Such notches are then only partially surrounded by the free end section of the bearing limb and opened towards the outside over part of the circumference.

It is particularly advantageous if a plurality of clamping springs are arranged in a row next to one another and spaced apart from one another and have a common busbar, which extends in the row arrangement direction of the clamping springs. In this way, for example, a terminal box can be implemented in which electrical conductors which are connected to the clamping springs arranged next to one another can be electrically conductively connected to one another via the busbar.

Preferably, the plurality of clamping springs have a common free end region of the resting limbs, which free end region extends in the row arrangement direction of the clamping springs. In this case, the clamping springs are formed integrally, i.e. in one piece, with the free end region. This means that the clamping springs are arranged in a stable position with respect to one another over the common free end section and a good flat resting area for the busbar is provided.

The invention will be explained in more detail below with reference to an exemplary embodiment having the attached drawings, in which.

Figure 1:
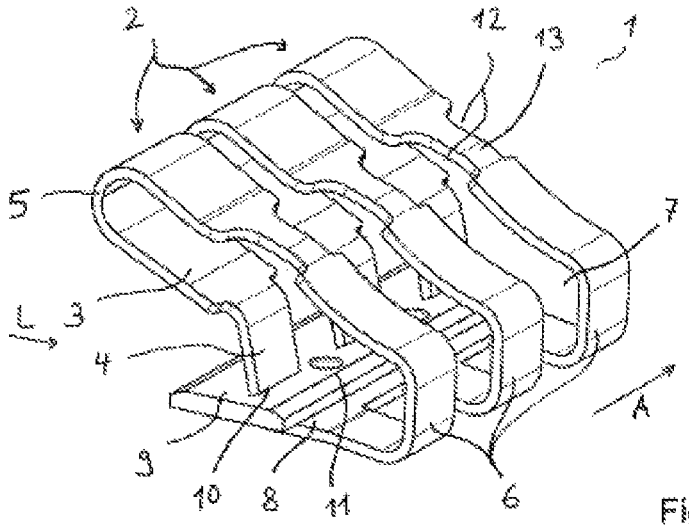
FIG. 1 shows a perspective view of a first embodiment of a spring-loaded terminal connection comprising three clamping springs arranged next to one another and a common busbar.

FIG. 1 shows a perspective view of a first embodiment of a spring-loaded terminal connection 1, which has three clamping springs 2 which are arranged next to one another and bent in the form of a loop. Each clamping spring 2 has a clamping limb 3 having a free clamping end 4.

The clamping limb 3 becomes a spring bend 5, which is adjoined by a resting limb 6. The resting limb 6 is bent back in the form of a U so as to form a conductor-receiving pocket 7 for receiving a free end, from which the insulation has been stripped, of an electrical conductor which is connected to the spring-loaded terminal connection. At the free end of the resting limb 6, the free end section 8 of the resting limb 6 forms a support area for a common busbar 9. In this case, the busbar 9 extends in the row arrangement direction A of the clamping springs 2 arranged next to one another and transversely to the conductor plug-in direction L.

It can be seen that the busbar 9 is mounted on the free end section 8 of the resting limb 6. It can furthermore be seen that the resting limbs 6 are formed in one piece, integrally with the free end region 8 and the clamping springs 2 which are arranged next to one another and spaced apart from one another are therefore connected to one another via the common free end section 8.

In the rest position illustrated, the free clamping end 4 of the clamping limb 3 rests on the busbar 9. When an electrical conductor is clamped in between the free clamping end 4 and the busbar 9, a terminal connection is provided between a clamping edge 10 at the free clamping end 4 and a contact edge 11 on the busbar 9 in order to make electrical contact between the electrical conductor and the busbar 9. The free clamping end 4 is bent back in the direction of the busbar 9 with respect to the clamping limb 3.

It can be seen that the resting limbs 6 each have two mutually opposite notches 12 in a section above the busbar 9 and the free clamping end 4 in the rest state. Thus, a web 13 is provided which has a reduced width in comparison with the adjoining sections of the resting limb 6. It can also be seen that the web 13 and the notches 12 have a very short length in comparison with the adjoining length of the resting limb 6 up to the busbar 9. The notch in this case extends over a length which is less than a quarter of the total length of the resting limb 6.

By virtue of the notches 12 and webs 13 implemented thereby, a type of hinge is provided between the spring bend 5 adjoining the web 13 and having the clamping limb 3 and the rest of the region of the resting limb 6 up to the busbar 9, which region adjoins the web 13. A force which is exerted on actuation of the clamping limb 3, for example by an actuating lever, an actuating slide or a screwdriver, and a force transmitted onto the resting limb 6 when an electrical conductor is connected is intercepted by the web 13 by slight deformation (bending) of the web 13 so as to reduce the force exerted on an adjoining insulating housing and is directed away towards the busbar 9. With the aid of the notch 12, a flexible section of the resting limb 6 which adjoins the spring bend 5 is thus provided, by means of which the influence of force on an insulating housing can be reduced.

In order to further stabilize the insulating housing, in this case it is additionally conceivable for sections of the insulating housing to dip into the notches 12 and therefore for this space of the notches 12 to also be used for reinforcing the insulating housing.

Figure 2:
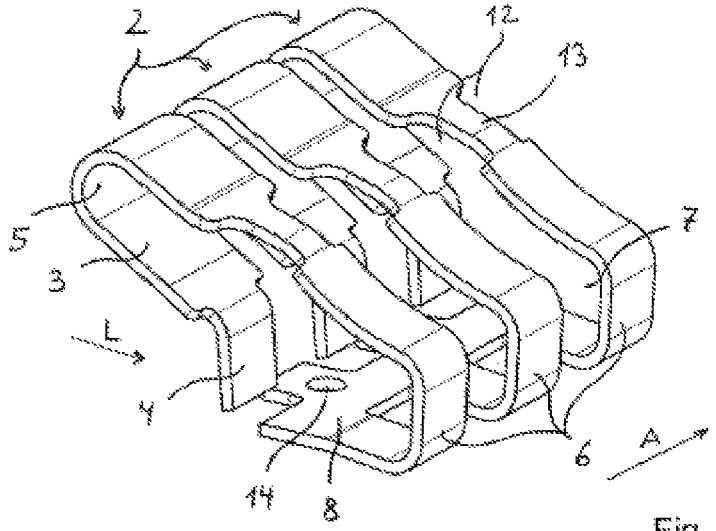
FIG. 2 shows a perspective view of the clamping springs of the spring-loaded terminal connection from FIG. 1.

FIG. 2 shows a perspective view of the clamping springs 2 of the spring-loaded terminal connection 1 from FIG. 1. In this case, it can be seen that the resting limbs 6 bent in the form of a U are connected integrally to one another via a common free end section 8, which extends in the row arrangement direction A and transversely to the conductor plug-in direction L beyond the three clamping springs 2. It can furthermore be seen that the free end section 8 has at least one bearing opening 14 for receiving a bearing lug of the busbar 9. In this way, the busbar 9 can be mounted on the free end section 8 and fixed in position. The busbar 9 is in this case not connected to the free end section 8 so fixedly that said end section cannot perform a tipping movement. The spring-loaded terminal connection 1 is therefore matched flexibly to the electrical conductor connected in each case.

Figure 3:
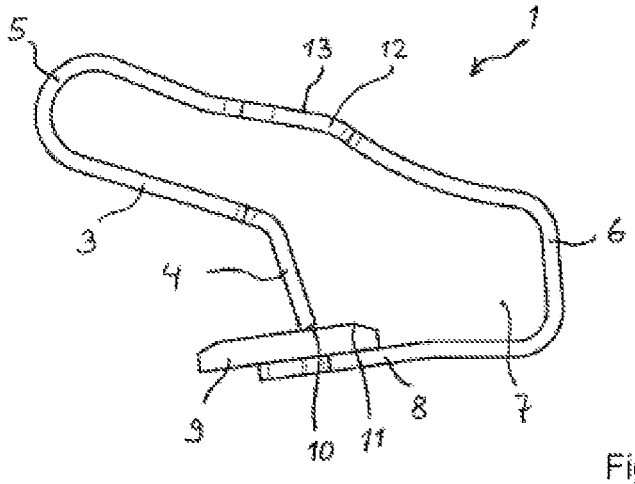
FIG. 3 shows a side view of the spring-loaded terminal connection from FIG. 1.

FIG. 3 shows a side view of the spring-loaded terminal connection 1 from FIG. 1. It can be seen here that the busbar 9 is mounted on the free end section 8 of the resting limbs 6. It can also be seen that a clamping edge 10 of the free clamping end 4 of the clamping limb 3 rests on the busbar 9 in the rest state. The web 13 formed by the notches 12 is in this case above the busbar 9 and the free clamping end 4, when viewed in a viewing direction transverse to the conductor plug-in direction L. With the aid of the webs 12, a flexible joint is provided between the section formed by the spring bend 5 and the clamping limbs 3 and the section between the busbar 9 and the adjoining section of the resting limb 6. The clamping force of the free clamping end 4 on an electrical conductor is in this case applied substantially by means of the spring bend 5. The flexible joint formed by the webs 13 means that further deformation forces are intercepted flexibly and are not transmitted to a large extent to the insulating housing.

Figure 4:
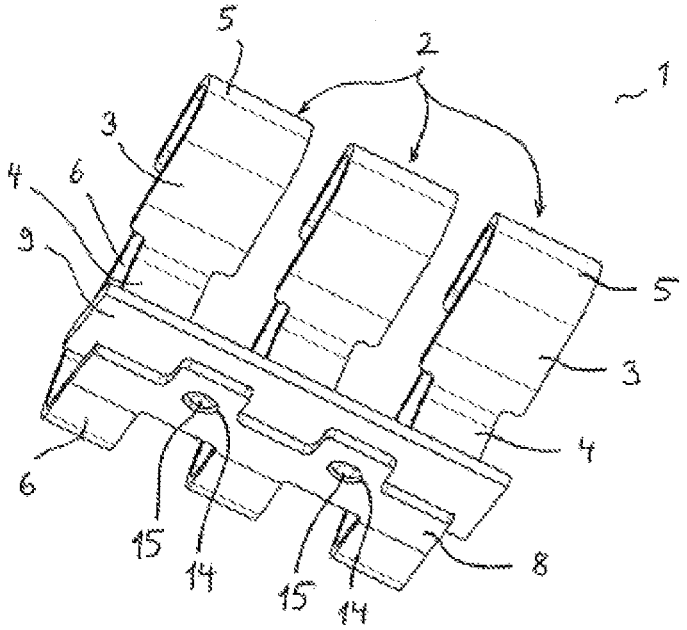
FIG. 4 shows a perspective view of the spring-loaded terminal connection from FIGS. 1 and 3 from below.

FIG. 4 shows a perspective view of the spring-loaded terminal connection 1 from FIG. 1 from below. It can be seen here that the free end section 8 of the resting limbs 6 has bearing openings 14, into which bearing lugs 15 protruding from the lower side of the busbar 9 protrude. The busbar 9 is therefore not connected fixedly to the free end section 8 in such a way that the busbar 9 cannot tip with respect to the free end section 8. However, it is fixed in position in the row arrangement direction A and transversely with the aid of the bearing lugs 15 and the bearing opening 14. In contrast to fastening of the busbar 9 to the free end section 8 by means of riveting, welding, screwing or the like, a tipping movement of the busbar 9 is possible with the result that the position of the busbar 9 can be matched sufficiently well to the position of a connected electrical conductor.

Figure 5:
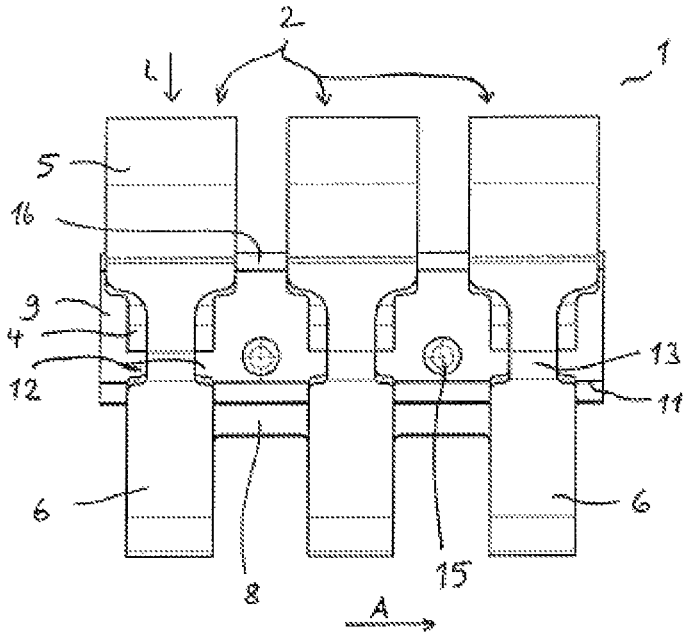
FIG. 5 shows a plan view of the spring-loaded terminal connection from FIG. 1.

FIG. 5 shows a plan view of the spring-loaded terminal connection from FIG. 1. It can be seen here that webs 13 are formed by the mutually opposite notches 12 in the peripheral regions of the resting limbs 6 adjacent to one another at the transition to the spring bend 5. It can be seen that the notches 12 and webs 13 are arranged in plan view above the busbar 9 and the free clamping end 4 of the clamping springs 2 in the rest position.

It can also be seen that the webs 13 have a narrower width than the width of the adjoining section of the resting limb 6 and the spring bend 5.

Recesses in the busbar can be seen, said recesses belonging to the downwardly protruding bearing lugs 15. These bearing lugs 15 are pressed downwards out of the material of the busbar 9 during the re-forming process.

It can also be seen that the busbar 9 have a run-on ramp 16, extending at an angle, in front of the free clamping end 4 of the clamping spring 2 and the contact edge 11, when viewed in the conductor insertion direction L. As a result, the insertion of an electrical conductor to the terminal connection is facilitated.

Figure 6:
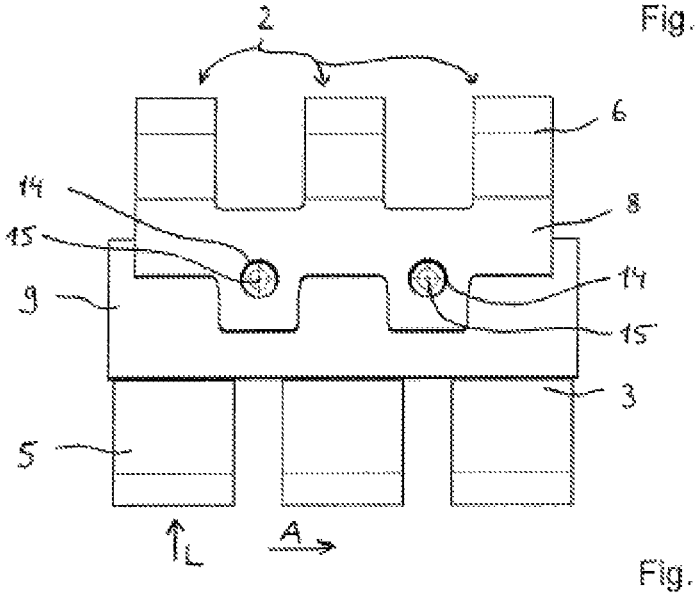
FIG. 6 shows a plan view of the spring-loaded terminal connection from FIG. 1 from below.

FIG. 6 shows a view of the spring-loaded terminal connection 1 from FIG. 1 from below. The bearing lugs 15 which protrude from the lower side of the busbar 9 in this case dip into the bearing opening 14 in the free end section 8 of the resting limbs 6.

Figure 7:
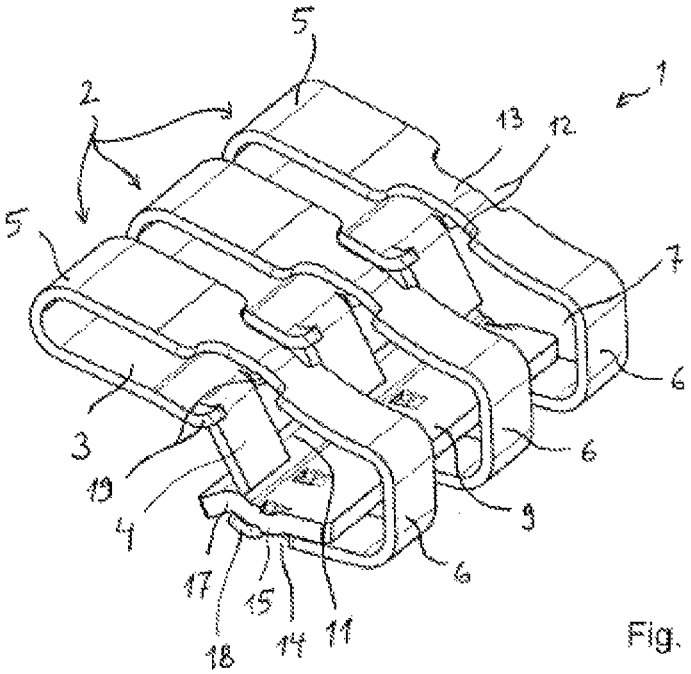
FIG. 7 shows a perspective view of a second embodiment of a spring-loaded terminal connection.

FIG. 7 shows a second embodiment of a spring-loaded terminal connection 1 in a perspective view. In this case too, the resting limbs 6 have webs 13 which are formed by mutually opposite notches 12 in a region adjoining the spring bend 5. To this extent, reference can be made to the above-described first exemplary embodiment of the spring-loaded terminal connection 1.

The embodiments differ firstly in terms of the bearing arrangement of the busbar 9 on the resting limbs 6 and secondly in terms of the configuration of the clamping limb 13.

It can be seen that bearing lugs 15 which are pressed inwards form the upper side of the busbar 9 to the lower side and protrude from the plane of the lower side of the busbar 9 are formed on the busbar 9. It can furthermore be seen that the busbar has a U-shaped bend 17 in front of the resting point of the free clamping end 4 over the length of extension of the busbar 9, when viewed in the conductor insertion direction L. The upper side of the U-shaped bend 17, which upper side extends in the row arrangement direction A, forms a contact edge 11 for an electrical conductor to be connected. In addition, the free end 18 of the free end section 8 of the resting limbs 6 is bent back upwards in the direction of the busbar 9, so that the busbar is fixed in position in connection with the bearing lugs 15, which dip into the bearing openings 14.

It can furthermore be seen that actuating tabs 19 protrude at the peripheral regions of the clamping limb 3. The actuating tabs 19 are bent easily upwards in the direction towards the resting limb 6 and form an actuating support, on which an actuating element, such as a swivel lever, for example, can apply an actuating force for opening a terminal connection by raising the clamping limb 3 in the direction of the opposite section of the resting limb 6. In the region of the actuating tabs 19, the free clamping end 4 is bent back in the direction of the busbar 9 with respect to the clamping limb 3.

In the exemplary embodiment illustrated, two actuating tabs 19 for a clamping spring 2 are provided at the two opposite peripheral regions of the clamping limb 3. However, it is also conceivable for only one actuating tab 19 per clamping spring 2 to be provided.

Figure 8:
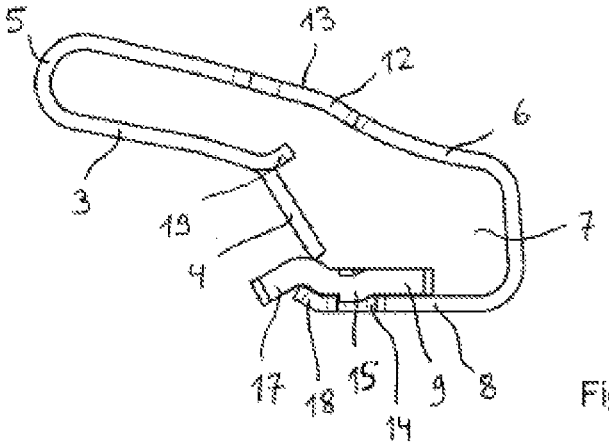
FIG. 8 shows a side view of the spring-loaded terminal connection from FIG. 7.

FIG. 8 shows a side view of the spring-loaded terminal connection from FIG. 7. In this case, it can once again be seen that the busbar rests, by virtue of the U-shaped bend 17, in that free end of the resting limb which is bent back upwards in the direction of the busbar 9 and is additionally fixed in position by the bearing lugs 15 behind said resting limb, which bearing lugs dip into the bearing openings 14 in the section of the resting limbs 6.

Figure 9:
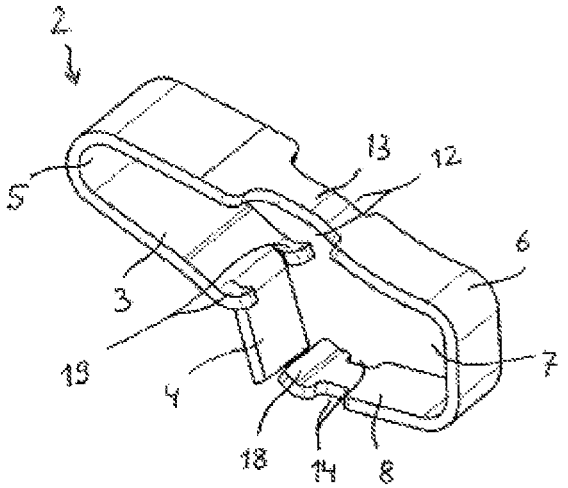
FIG. 9 shows a perspective view of a clamping spring of the spring-loaded terminal connection from FIG. 7.

FIG. 9 shows a perspective view of the clamping spring 2 for the spring-loaded terminal connection from FIGS. 7 and 8. It can be seen that the individual clamping springs 2 arranged next to one another are now separate from one another. The bearing openings 14 in this embodiment are formed by notches in the peripheral region of the resting limb 6 in the free end section and are therefore not closed circumferentially over the entire circumference. It can also be seen that the free end 18 of the free end section 8 is bent back from the plane of the free end section 8 upwards in the direction of the web 13 or in the direction of the free clamping end 4 of the clamping limb which is approximately above said web. It can furthermore be seen that the actuating tabs 19 are formed on both sides on the peripheral regions of the clamping limb 3 by the clamping end 4 being cut or stamped free and said clamping end being folded under in the direction of the free end section 8.

Figure 10:
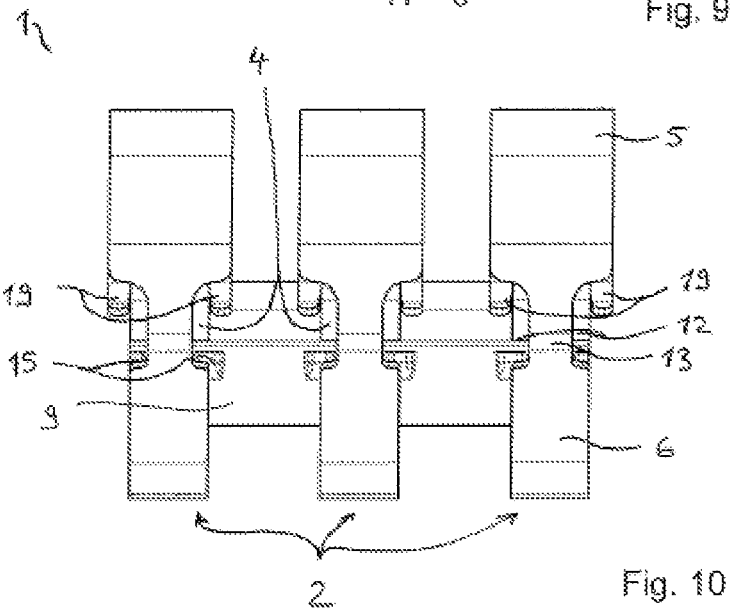
FIG. 10 shows a plan view of the spring-loaded terminal connection from FIG. 7.

FIG. 10 shows a plan view of the spring-loaded terminal connection 1 from FIG. 7. It can be seen here that the actuating tabs 19 are, in plan view, in the space beneath the webs 13 and the notches 12 forming said webs. The free clamping end 4 of the clamping limb 3, the actuating tabs 19 and the notches 12 for forming the webs 13 are therefore approximately aligned one above the other.

Figure 11:
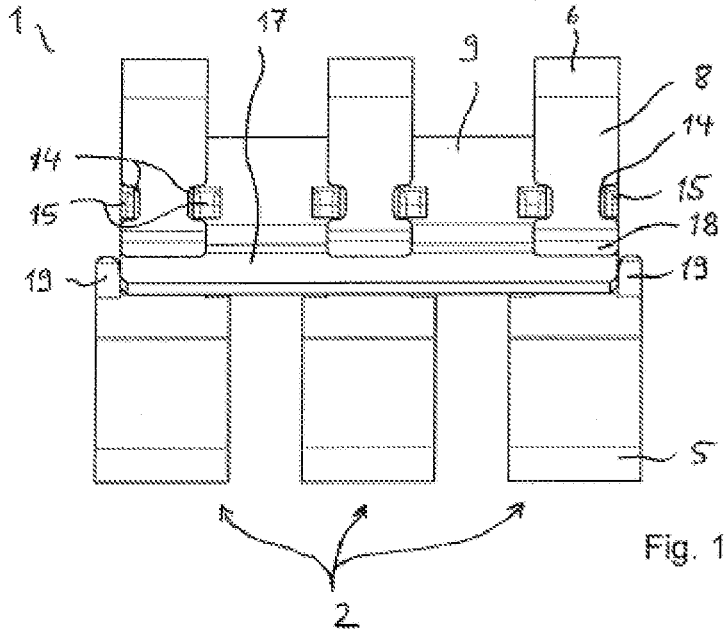
FIG. 11 shows a view of the spring-loaded terminal connection from FIG. 7 from below.

FIG. 11 shows a view of the spring-loaded terminal connection 1 from FIG. 7 from below onto the busbar 9. It can be seen here that the protruding bearing lugs 15 dip into the bearing openings 14 formed from notches at the free end section 8 of the resting limbs 6.

Figure 12:
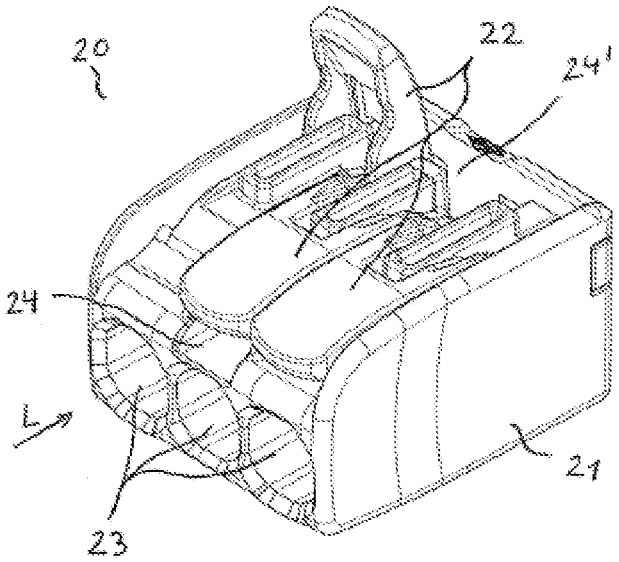
FIG. 12 shows a perspective view of a conductor connection terminal comprising an actuating lever.

FIG. 12 shows a perspective view of a conductor connection terminal 20. The conductor connection terminal 20 has an insulating housing 21, in which one of the above-described spring-loaded terminal connections 1 comprising three clamping springs 2 arranged next to one another is built (not shown). In order to actuate the spring-loaded terminal connections 1, i.e. in order to open the terminal connections formed thereby for connecting an electrical conductor, actuating levers 22 are accommodated pivotably in the insulating housing 21. Furthermore, the insulating housing has, on the front side, conductor insertion openings 23 for inserting electrical conductors to form an associated terminal connection of a clamping spring 2. These conductor insertion openings 23 extend into the conductor insertion opening L in the interior of the insulating housing 21.

Furthermore, it can be seen that a test opening 24 extending in the conductor insertion direction L is provided above the central conductor insertion opening 23. The test opening 24 is open at the end side and towards the adjoining spring-loaded terminal connection 1 in the interior, with the result that it is possible to establish, with the aid of an inserted test tool, whether a voltage potential is present at the spring-loaded terminal connection 1. As an alternative or in addition to this, it is also conceivable for a test opening 24' to be provided in the rear region opposite the conductor insertion openings 23 on the upper side or rear side.

Figure 13:
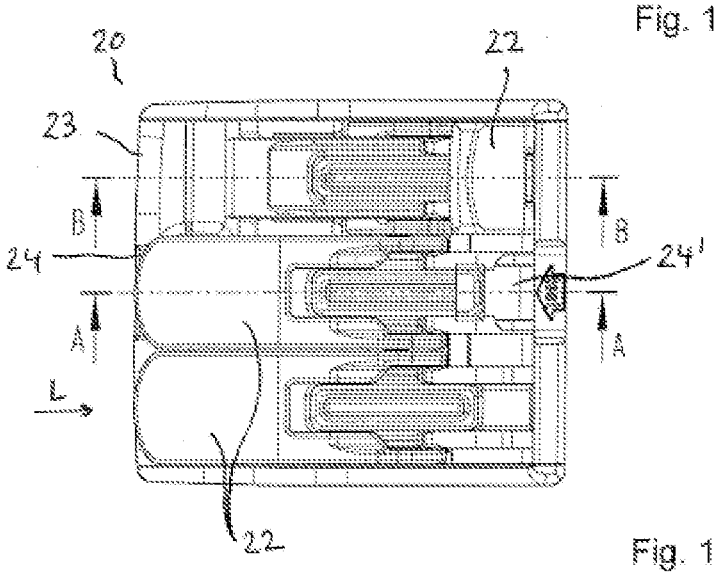
FIG. 13 shows a plan view of the conductor connection terminal from FIG. 12.

FIG. 13 shows a plan view of the conductor connection terminal 20 with the section lines A-A and B-B. The upper actuating lever, on the left-hand side in FIG. 12, is in the open position and is pivoted away from the insulating housing. Therefore, the terminal connection of the assigned clamping spring is open. The other two actuating levers 22 are folded down in the direction of the insulating housing 21 in the closed position, with the result that the terminal connection is closed and the assigned clamping spring exerts, via the free clamping section 4, a clamping force on the busbar therebeneath and a possibly interposed electrical conductor (not illustrated).

Figure 14:
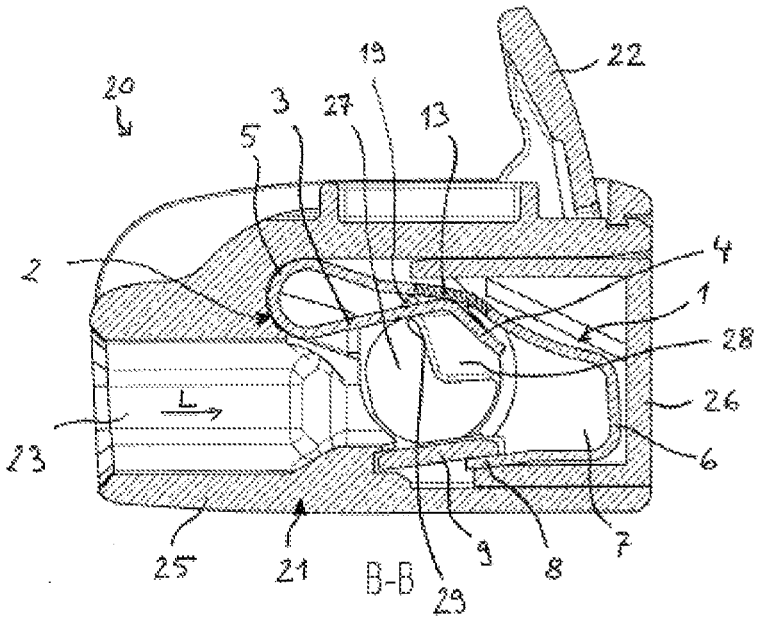
FIG. 14 shows a side sectional view through the conductor connection terminal from FIGS. 12 and 13 in the section B-B when the actuating lever is open.

FIG. 14 shows a side sectional view in the section B-B through the conductor connection terminal 21 from FIGS. 12 and 13. In this case, it is clear that an above-described spring-loaded terminal connection 1 is built into the interior of the insulating housing 21. The insulating housing 21 is in this case formed in two parts and has a clamping housing part 25 and a cover part 26, which closes said clamping housing part on the rear side. It can be seen that the actuating lever 22 mounted pivotably in the insulating housing 21 has, in the interior between the busbar 9 and the web 13, a pivot bearing journal 27 with a V-shaped cut-out portion 28 of approximately 80 to 120° (approximately 110° in the exemplary embodiment illustrated). The V-shaped cut-out portion 28 enables an actuating contour 29 which acts on an assigned actuating tab 19 in order to move the clamping limb 3 so as to open the terminal connection in the direction of the web 13 thereabove.

Figure 15:
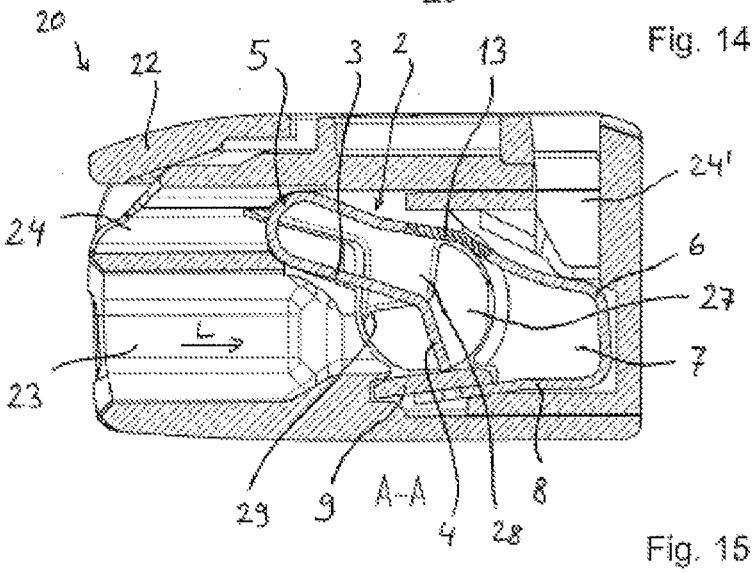
FIG. 15 shows a side sectional view through the conductor connection terminal from FIGS. 12 and 13 in the section A-A when the actuating lever is closed.

FIG. 15 shows a side sectional view of the conductor connection terminal 20 when the actuating lever 22 is closed in the section A-A in FIG. 13. It can be seen here that the terminal connection is now closed. This is achieved by virtue of the fact that the pivot journal 27 is rotated through approximately 90°. In this case, the actuating tab 19 is released and the clamping limb 3 can move freely under the spring force applied by the spring bend 5 and can exert a clamping force on the busbar and an electrical conductor arranged possibly between the busbar and the free clamping end 4.

A type of spring-loaded joint or hinge is formed by the web 13, with the result that a force acting via the clamping limb 3 and the spring bend is absorbed flexibly by the clamping spring 2 itself without substantial force being transmitted onto the insulating housing.

In comparison with FIG. 15, it can be seen from FIG. 14 that the upper section of the resting limb 6 is moved upwards in the region of the web 13 in the open position. This is achieved by the flexible web 13, which is more elastic than the adjoining section of the resting limb 6 owing to its reduced width.

In the section A-A illustrated, the front test opening 24 above the central conductor insertion opening 23 and a rear-side test opening 24' which is accessible from above can also be seen.

Figure 16:
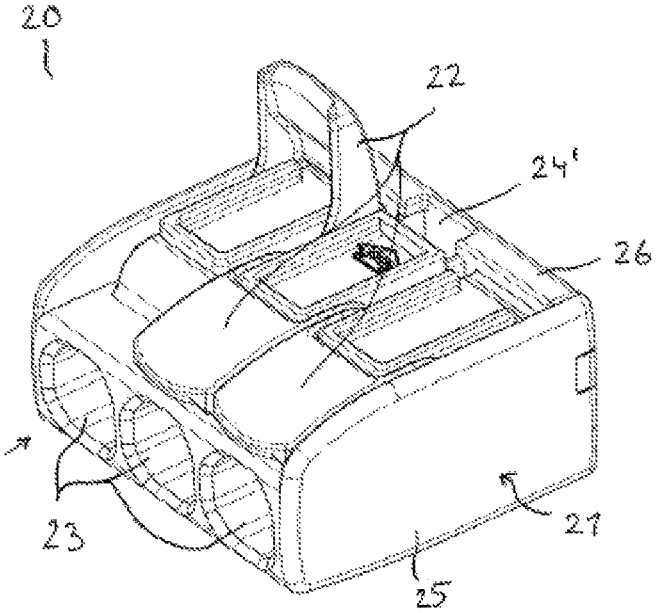
FIG. 16 shows a perspective view of a second embodiment of a conductor connection terminal.

FIG. 16 shows a second embodiment of a conductor connection terminal 20. In this case, reference can first be made to the description of the first embodiment. In contrast to the first embodiment, there is no front test opening, but only a rear-side test opening 24'. The actuating levers 22 and the insulating housing 21 therebetween are also slightly different.

Figure 17:
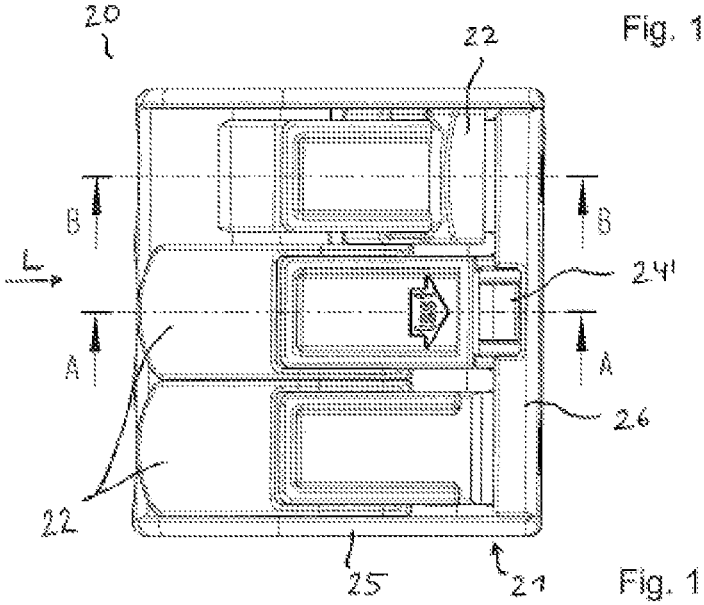
FIG. 17 shows a plan view of the conductor connection terminal from FIG. 16.

FIG. 17 shows a plan view of the second embodiment of the conductor connection terminal 20 from FIG. 16 with the section lines A-A and B-B.

Figure 18:
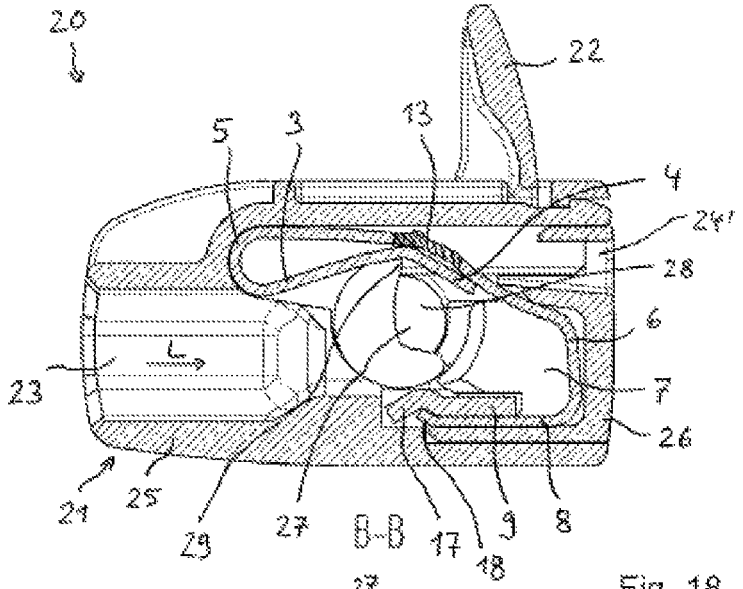
FIG. 18 shows a side sectional view through the conductor connection terminal from FIGS. 16 and 17 in the section B-B when the actuating lever is open.

FIG. 18 shows the conductor connection terminal 20 from FIGS. 16 and 17 in the section B-B of the open actuating lever 22 when the terminal connection is open. In this case too, a pivot journal 27 in the form of a part-circle is arranged at the level above the busbar 9 and below the web 13 and is mounted pivotably in the insulating housing. The busbar 9 is in this case embodied with a U-shaped bend 17 in a manner comparable to the second exemplary embodiment of a spring-loaded terminal connection 1 shown in FIGS. 7 to 11. The actuating contour 29 formed on the pivot journal 27 is slightly different than in the first embodiment shown in FIGS. 14 and 15, but is functionally comparable. Therefore, reference can substantially be made to the explanation in respect of the first exemplary embodiment.

Figure 19:
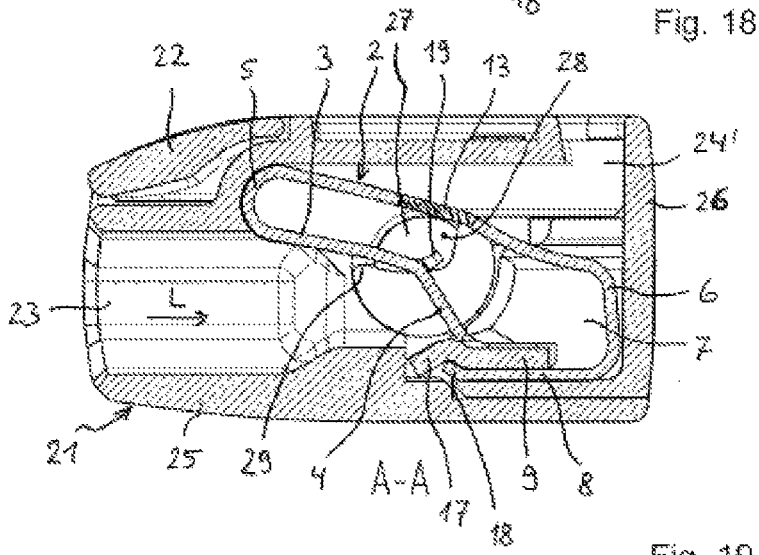
FIG. 19 shows a side sectional view through the conductor connection terminal from FIGS. 16 and 17 in the section A-A when the actuating lever is closed.

FIG. 19 shows a side sectional view of the conductor connection terminal 20 from FIGS. 16 and 17 in the section A-A when the actuating lever 22 is closed. In this case, the terminal connection is closed by virtue of the free clamping end 4 of the clamping limb 3 being pressed down in the direction of the busbar 9 by the spring force of the clamping spring 5. Without the electrical conductor inserted, as illustrated, the free clamping end 4 then rests on the busbar.

The invention claimed is:

1. A spring-loaded terminal connection, comprising:

at least one clamping spring bent in the form of a loop and comprising a busbar, wherein the clamping spring has a resting limb, which rests against the busbar, a spring bend, which adjoins the resting limb, and a clamping limb, which adjoins the spring bend and points with a free clamping end in the direction of the busbar, wherein the resting limb is bent back in the form of a U so as to form a conductor-receiving pocket for receiving a free end, stripped of insulation, of an electrical conductor which can be connected to the spring-loaded terminal connection, and has at least one flexible joint in a section opposite the busbar, the at least one flexible joint being formed by at least one notch in the section opposite the busbar.

2. The spring-loaded terminal connection as claimed in claim 1, wherein a pair of mutually opposite notches is provided on both sides of a resting limb, and the resting limb has, in the region of the notches, a web having a reduced width in comparison with those sections of the resting limb which are directed towards the spring bend and the busbar.

3. The spring-loaded terminal connection as claimed in claim 1, wherein the busbar is mounted on the resting limb so as to be capable of performing a tipping movement.

4. The spring-loaded terminal connection as claimed in claim 1, wherein the resting limb has, at its free end section, bearing openings or bearing depressions and bearing lugs protruding beyond the busbar, wherein the bearing lugs each dip into an assigned bearing opening or bearing depression.

5. The spring-loaded terminal connection as claimed in claim 4, wherein bearing openings at the free end section of the resting limb are in the form of notches in the peripheral regions of the free end section.

6. The spring-loaded terminal connection as claimed in claim 1, wherein a plurality of clamping springs are arranged in a row next to one another and spaced apart from one another and have a common busbar, which extends in the row arrangement direction of the clamping springs.

7. The spring-loaded terminal connection as claimed in claim 6, wherein the plurality of clamping springs have a common free end region of the resting limbs, which free end region extends in the row arrangement direction of the clamping springs, wherein the clamping springs are formed integrally with the free end region.

8. A conductor connection terminal comprising an insulating housing, comprising at least one spring-loaded terminal connection as claimed in claim 1 in the insulating housing.

9. The spring-loaded terminal connection as claimed in claim 8, wherein the plurality of clamping springs have a common free end region of the resting limbs, which free end region extends in the row arrangement direction of the clamping springs, wherein the clamping springs are formed integrally with the free end region.

10. A conductor connection terminal comprising an insulating housing, comprising at least one spring-loaded terminal connection as claimed in claim 1 in the insulating housing.

* * * * *